US009007159B2

(12) United States Patent
Hachiya et al.

(10) Patent No.: US 9,007,159 B2
(45) Date of Patent: Apr. 14, 2015

(54) COIL-TYPE ELECTRONIC COMPONENT

(71) Applicant: Taiyo Yuden Co., Ltd., Taito-ku, Tokyo (JP)

(72) Inventors: Masahiro Hachiya, Takasaki (JP); Atsushi Tanada, Gunma (JP); Kenji Otake, Takasaki (JP); Kiyoshi Tanaka, Gunma (JP); Tetsuyuki Suzuki, Gunma (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 13/708,614

(22) Filed: Dec. 7, 2012

(65) Prior Publication Data

US 2013/0154784 A1 Jun. 20, 2013

(30) Foreign Application Priority Data

Dec. 15, 2011 (JP) ..... 2011-274265

(51) Int. Cl.

| | |
|---|---|
| ***H01F 5/00*** | (2006.01) |
| ***H01F 17/04*** | (2006.01) |
| ***H01F 27/28*** | (2006.01) |
| ***H01F 27/24*** | (2006.01) |
| ***H01F 1/33*** | (2006.01) |

(52) U.S. Cl.

CPC ..... *H01F 5/003* (2013.01); *H01F 1/33* (2013.01); *H01F 17/045* (2013.01)

(58) Field of Classification Search

USPC ..... 336/200, 221, 232, 233, 234, 83

See application file for complete search history.

(56) References Cited

U.S. PATENT DOCUMENTS

| | | | |
|---|---|---|---|
| 4,129,444 | A | 12/1978 | Dreyer et al. |
| 5,352,522 | A | 10/1994 | Kugimiya et al. |
| 5,522,946 | A | 6/1996 | Tomita et al. |
| 5,997,999 | A | 12/1999 | Horiuchi et al. |
| 6,392,525 | B1 | 5/2002 | Kato et al. |
| 6,515,568 | B1 | 2/2003 | Maki et al. |
| 6,764,643 | B2 | 7/2004 | Sagawa et al. |
| 6,784,782 | B2 | 8/2004 | Inoue et al. |
| 6,814,928 | B2 | 11/2004 | Sagawa et al. |
| 7,422,697 | B2 | 9/2008 | Takahashi et al. |

(Continued)

FOREIGN PATENT DOCUMENTS

| | | | |
|---|---|---|---|
| CN | 101308719 | A | 11/2008 |
| CN | 101927344 | A | 12/2010 |

(Continued)

OTHER PUBLICATIONS

A Notification of Examination Opinions with Search Report issued by Taiwan Intellectual Property Office, mailed Apr. 16, 2014, for Taiwan counterpart application No. 101147082.

(Continued)

*Primary Examiner* — Elvin G Enad
*Assistant Examiner* — Kazi Hossain
(74) *Attorney, Agent, or Firm* — Law Office of Katsuhiro Arai

(57) ABSTRACT

A coil-type electronic component having a coil inside or on the surface of a base material is characterized in that the base material of the coil-type electronic component is constituted by a group of soft magnetic alloy grains inter-bonded via oxide layers, multiple crystal grains are present in each soft magnetic alloy grain, and the oxide layers preferably have a two-layer structure whose outer layer is thicker than the inner layer.

8 Claims, 5 Drawing Sheets

(56) References Cited

U.S. PATENT DOCUMENTS

| | | | | |
|---|---|---|---|---|
| 7,446,638 | B2 | 11/2008 | Nogi | |
| 7,719,399 | B2 | 5/2010 | Iwasaki | |
| 7,843,701 | B2 | 11/2010 | Kudo et al. | |
| 8,018,313 | B2 | 9/2011 | Tada et al. | |
| 8,416,051 | B2 | 4/2013 | Matsuura et al. | |
| 2004/0140016 | A1 | 7/2004 | Sakamoto et al. | |
| 2004/0209120 | A1* | 10/2004 | Inoue et al. | 428/694 B |
| 2007/0290161 | A1* | 12/2007 | Tokuoka et al. | 252/62.54 |
| 2008/0003126 | A1 | 1/2008 | Watanabe et al. | |
| 2008/0012679 | A1 | 1/2008 | Okabe et al. | |
| 2008/0029300 | A1 | 2/2008 | Harada et al. | |
| 2008/0061264 | A1 | 3/2008 | Maeda et al. | |
| 2008/0152897 | A1* | 6/2008 | Maeda et al. | 428/323 |
| 2008/0231409 | A1 | 9/2008 | Kugai et al. | |
| 2008/0278273 | A1 | 11/2008 | Lee et al. | |
| 2009/0003191 | A1 | 1/2009 | Inuzuka et al. | |
| 2009/0045905 | A1 | 2/2009 | Nakagawa et al. | |
| 2009/0102589 | A1 | 4/2009 | Lee et al. | |
| 2009/0140833 | A1 | 6/2009 | Tan et al. | |
| 2010/0033286 | A1 | 2/2010 | Katayama et al. | |
| 2010/0253463 | A1* | 10/2010 | Shimomura et al. | 336/200 |
| 2010/0287764 | A1 | 11/2010 | McGregor et al. | |
| 2010/0289609 | A1 | 11/2010 | Liao et al. | |
| 2011/0024670 | A1 | 2/2011 | Otsuki et al. | |
| 2011/0133881 | A1 | 6/2011 | Nakajima et al. | |
| 2011/0181384 | A1 | 7/2011 | Inuduka et al. | |
| 2011/0227690 | A1* | 9/2011 | Watanabe et al. | 336/221 |
| 2011/0267167 | A1* | 11/2011 | Ogawa et al. | 336/221 |
| 2012/0038449 | A1 | 2/2012 | Ogawa et al. | |
| 2012/0070567 | A1 | 3/2012 | Watanabe et al. | |
| 2012/0274437 | A1* | 11/2012 | Matsuura et al. | 336/221 |
| 2013/0154786 | A1 | 6/2013 | Nakajima et al. | |

FOREIGN PATENT DOCUMENTS

| | | | | |
|---|---|---|---|---|
| CN | 102007549 | A | | 4/2011 |
| JP | H04-346204 | A | | 12/1992 |
| JP | 07-201570 | A | | 8/1995 |
| JP | H09-074011 | A1 | | 3/1997 |
| JP | 2000-030925 | A1 | | 1/2000 |
| JP | 2001-011563 | A1 | | 1/2001 |
| JP | 2001-118725 | A1 | | 4/2001 |
| JP | 2002-305108 | A1 | | 10/2002 |
| JP | 2002-313620 | A1 | | 10/2002 |
| JP | 2002-343618 | A1 | | 11/2002 |
| JP | 2005-286145 | A | | 10/2005 |
| JP | 2006-202956 | A | | 8/2006 |
| JP | 2007-019134 | A1 | | 1/2007 |
| JP | 2007-027354 | A | | 2/2007 |
| JP | 2007-027354 | A1 | | 2/2007 |
| JP | 2008195986 | | * | 2/2007 |
| JP | 2007-123703 | A1 | | 5/2007 |
| JP | 2007-258427 | A | | 10/2007 |
| JP | 2007-299871 | A1 | | 11/2007 |
| JP | 2008-028162 | A1 | | 2/2008 |
| JP | 2008-041961 | A1 | | 2/2008 |
| JP | 2008041961 | | * | 2/2008 |
| JP | 2008-195986 | A1 | | 8/2008 |
| JP | 2009-088496 | A1 | | 4/2009 |
| JP | 2009-088502 | A1 | | 4/2009 |
| JP | 2009088502 | | * | 4/2009 |
| JP | 2011-249774 | A1 | | 12/2011 |
| TW | 200845057 | A | | 11/2008 |
| TW | M388724 | U1 | | 9/2010 |
| WO | 2009/128425 | A1 | | 10/2009 |
| WO | 2010/013843 | A1 | | 2/2010 |

OTHER PUBLICATIONS

Office Action issued by the Korean Patent Office, mailed Nov. 15, 2013, for Korean counterpart application No. 10-2012-0130937.

* cited by examiner $$\sigma b = \frac{M}{I} \times \frac{h}{2} = \frac{3WL}{2bh^2}$$

Width of test piece: b (mm)
Thickness of test piece: h (mm)
3-point bending rupture stress (σb)
Bending moment: M
Geometrical moment of inertia: I Electrode Layout in Resistivity Test Volume resistivity: ρV (Ωcm)
Outer diameter of inner circle of top-side electrode: d (cm)
Thickness of test piece: t (cm)
Volume resistance: Rv (Ω)

$$\rho_V = \frac{\pi d^2}{4t} \times R_V$$

COIL-TYPE ELECTRONIC COMPONENT

BACKGROUND

1. Field of the Invention

The present invention relates to a coil-type electronic component, and more specifically to a coil-type electronic component using a soft magnetic alloy, suitable for a compact coil-type electronic component that can be surface-mounted on a circuit board.

2. Description of the Related Art

Magnetic cores of choke coils used in high-frequency applications are traditionally ferrite cores, cores cut from thin metal sheets, and powder-compressed magnetic cores.

Use of metal magnetic materials has an advantage over ferrites, as these materials can achieve high saturated magnetic flux densities. However, metal magnetic materials are poor in insulation property and must be given insulation treatment.

Patent Literature 1 proposes mixing a Fe—Al—Si powder having surface oxide film with a binder, compression-molding the mixture, and then heat-treating the molded product in an oxidizing ambience. According to the patent literature, heat-treating the molded product in an oxidizing ambience has the effect of forming an oxide layer (alumina) in those areas of the insulation layer on the surface of the alloy powder that have broken during compression molding, thereby achieving a complex magnetic material offering good direct-current superimposition characteristics with minimal core loss.

Patent Literature 2 describes laminating a metal magnetic layer formed by a metal magnetic paste which contains metal magnetic grains as the main ingredient, and also glass, with a conductive pattern formed by a conductive paste containing silver or other metal, and then baking the obtained laminated electronic component, which has the coil pattern formed in the laminate, at a temperature of 400° C. or above in a nitrogen ambience.

BACKGROUND ART LITERATURES

[Patent Literature 1] Japanese Patent Application Laid-open No. 2001-11563

[Patent Literature 2] Japanese Patent Application Laid-open No. 2007-27354

SUMMARY

The complex magnetic material in Patent Literature 1 requires a high pressure during compression molding because the Fe—Al—Si powder used for molding has an oxide film formed on its surface beforehand.

This material also presents another problem in that, when it is applied to a power inductor or other electronic component through which higher current must flow, further size reduction cannot be fully supported.

On the other hand, the laminated electronic component proposed in Patent Literature 2 is a laminated electronic component using a metal magnetic layer which is formed by a metal magnetic paste that contains metal magnetic grains as the main ingredient, and also glass. Although the resistance improves due to the glass layer, the fill ratio of the metal magnetic material drops due to the mixing of glass and the magnetic permeability μ and other magnetic characteristics also drop.

The present invention was developed in light of the aforementioned situation and the object of the present invention is to provide a coil-type electronic component that can be produced at low cost and comprises a magnetic material offering higher magnetic permeability and higher saturated magnetic flux density at the same time, as well as a method of manufacturing such coil-type electronic component.

Any discussion of problems and solutions involved in the related art has been included in this disclosure solely for the purposes of providing a context for the present invention, and should not be taken as an admission that any or all of the discussion were known at the time the invention was made.

After continuous research in earnest to achieve the aforementioned object, the inventors of the present invention found that, by mixing with a binder and molding soft magnetic alloy grains whose main ingredients are iron, silicate, and chromium, or iron, silicate, and aluminum, and then heat-treating the molded product in an oxygen-containing ambience under specific conditions, the binder would break down due to the heat treatment and an oxide layer would be formed on the surface of the heat-treated metal grains, after which the alloy grains would bond together due to this oxide layer, thereby increasing the magnetic permeability after the heat treatment compared to the level before the heat treatment, while producing crystal grains in the heat-treated alloy grains (hereinafter referred to sometimes as "in-grain crystal grains"), and the presence of these in-grain crystal grains would achieve high magnetic permeability μ and low magnetic loss Pcv at the same time. Such multiple crystal grains have different orientation axes and constitute a mosaic pattern on a cross section of each soft magnetic alloy grain. It was also revealed that, by forming this oxide layer preferably as a two-layer structure where the inner layer of the two-oxide-layer structure is formed as an oxide layer whose main component is chromium oxide or aluminum oxide and with which soft magnetic alloy grains are coated, progress of oxidization in the magnetic alloy grains could be prevented and deterioration of characteristics could be suppressed. It was also revealed that the outer layer of the two-oxide-layer structure is formed as an oxide layer whose main component is iron-chromium oxide or iron-aluminum oxide and which is thicker than the aforementioned inner layer, and therefore insulation property could be improved. The above layers need not be discrete but can have a gradient transition between the two layers. Furthermore, it was found that, because the surface oxide layer not involved in the inter-bonding of alloy grains has irregularities and the specific surface area of grains increases after the heat treatment, insulation property would improve further.

The present invention was completed based on the aforementioned findings, and is described as follows:

<1> A coil-type electronic component having a coil inside or on the surface of a base material, characterized in that the base material is constituted by a group of soft magnetic alloy grains inter-bonded via oxide layers and multiple crystal grains are present in each soft magnetic alloy grain.

<2> A coil-type electronic component according to <1>, characterized in that the soft magnetic alloy contains iron, chromium and silicate as its main ingredients.

<3> A coil-type electronic component according to <1>, characterized in that the soft magnetic alloy contains iron, aluminum and silicate as its main ingredients.

<4> A coil-type electronic component according to any one of <1> to <3>, characterized in that the base material has the soft magnetic alloy grains inter-bonded not via the oxide layers.

<5> A coil-type electronic component according to any one of <1> to <4>, characterized in that the oxide layers have a two-layer structure where the outer layer is thicker than the inner layer.

<6> A coil-type electronic component according to any one of <1> to <5>, characterized in that the surface of the outer oxide layer not inter-bonding the soft magnetic alloy grains has irregularities.

According to the present invention, by properly heat-treating soft magnetic alloy grains whose main ingredients are iron, silicate and chromium, or iron, silicate, and aluminum, and by inter-bonding the alloy grains via the oxide layer formed on the grain surface, the magnetic permeability after the heat treatment increases compared to the level before the heat treatment and insulation property improves as a result, while at the same time the heat treatment produces crystal grains in the heat-treated alloy grains and the presence of these in-grain crystal grains achieves high magnetic characteristics μ and low magnetic loss, which, combined with the grain-bonding effect via the oxide layer, improves the characteristics of the product. If the oxide layer has a two-layer structure, a thick oxide layer constituted primarily by iron-chromium oxide or iron-aluminum oxide and offering higher specific resistance can be formed as an outer layer of the oxide layer traditionally formed on the alloy grain surface and containing chromium or aluminum at a high ratio, which then improves insulation property. Also because the soft magnetic alloy grain is coated by the inner layer formed as an oxide layer whose main ingredient is chromium oxide or aluminum oxide, excessive progress of oxidization in the soft magnetic alloy grain can be prevented and deterioration of characteristics can be suppressed. Furthermore, the heat treatment under the present invention produces irregularities on the grain surface and increases the specific area, which in turn achieves the inter-bonding of alloy grains demonstrated by prior art to improve μ, while at the same time the irregularities of the surface oxide layer not bonding the alloy grains increase the surface resistance and thereby improve the insulation property further.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
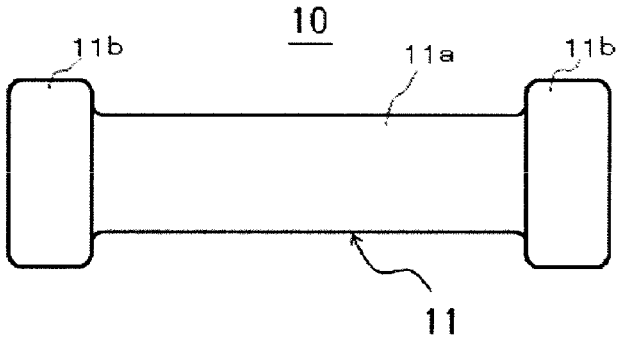
FIG. 1 is a side view showing a first embodiment of a base material using a soft magnetic alloy for an electronic component conforming to the present invention.

1: Grain
2: Inner layer of an oxide layer
3: Outer layer of an oxide layer
10, 10': Base materials using a soft magnetic alloy for an electronic component
11: Drum-type core
11*a*: Winding center
11*b*: Flange part
12: Sheet-shaped core
14: External conductive film
14*a*: Baked conductive film layer
14*b*: Ni plating layer
14*c*: Sn plating layer
15: Coil
15*a*: Winding part
15*b*: End (joined part)
20: Electronic component (winding-type chip inductor)
31: Laminated chip
34: External conductive film
35: Internal coil
40: Electronic component (laminated chip inductor)

DETAILED DESCRIPTION OF EMBODIMENTS

In the present disclosure, "an oxide layer formed as a result of oxidation of the grain" refers to an oxide layer formed by oxidation greater than natural oxidation of the grain, which oxide layer is an oxide layer grown by reacting a surface of the grain and oxygen by heat treatment of a molded body formed from grains in an oxidizing atmosphere. Also, a "layer" refers to a layer distinguishable from others based on its compositions, structures, properties, appearance, and/or production processes, etc., including a layer having a discrete or unclear boundary, and a layer which is a continuous film on the surface of a grain or which is a film having partially a discontinued portion. In some embodiments, an "oxide layer" is a continuous film covering the entire surface of each grain. Further, such an oxide layer possesses any of the characteristics identified in the present disclosure, and the oxide layer grown by oxidation of the grain surface can be distinguished from an oxide film formed by other methods. In the present disclosure, relative terms such as "greater", "easier", etc.

refer to substantial differences by degrees which cause significant differences in function, structure, or effect/result.

The following explains a first embodiment of a base material using a soft magnetic alloy for an electronic component conforming to the present invention, by referring to FIGS. 1 to 5. FIG. 1 is a side view showing the exterior of a base material 10 using a soft magnetic alloy for the electronic component in this embodiment. The base material 10 using a soft magnetic alloy for the electronic component in this embodiment is used as a core around which a coil of a coil-type chip inductor is wound. The drum-type core 11 has a sheet-shaped winding center 11*a* which is provided in parallel with the mounting surface of a circuit board, etc., and around which a coil is wound, and a pair of flange parts 11*b*, 11*b* provided at the opposing ends of the winding center 11*a*, which has a drum-type appearance. Coil ends are electrically connected to a conductive film 14 formed on the surface of flange parts 11*b*, 11*b*.

The base material 10 using a soft magnetic alloy for an electronic component, as proposed by the present invention, is characterized in that it is constituted by a group of soft magnetic alloy grains whose main ingredients are iron (Fe), silicate (Si), and chromium (Cr), or iron (Fe), silicate (Si), and aluminum (Al), where formed on the surface of each soft magnetic grain is a layer of metal oxide produced by heat-treating the grain properly in an oxygen-containing ambience and thereby oxidizing the grain (hereinafter referred to as "oxide layer"), and after the heat treatment the crystallinity of the alloy powder grain increases and crystal grains are formed in the grain.

The remainder of the Specification uses specific names or symbols to refer to the elements.

Figure 2:
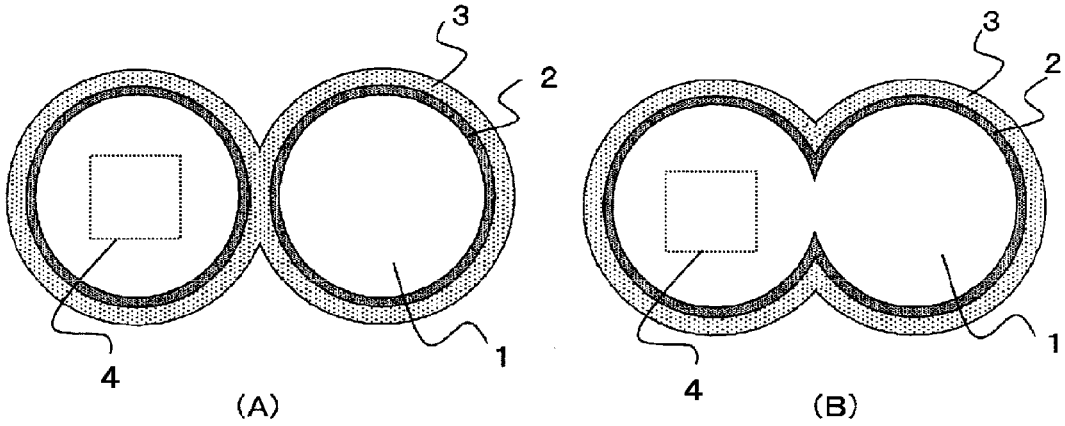
FIG. 2 is a schematic view illustrating an oxide layer model formed according to the preset invention.

FIG. 2 is a schematic view of a simplified model comprising two soft magnetic alloy grains with the aim of explaining the oxide layer under the present invention in an easy-to-understand manner. In the figure, the broken line 4 indicates the portion illustrated in the schematic enlarged view of crystal grains produced in the grain as shown in the next figure, FIG. 3.

The oxide layer is produced on the surface of the grain 1 as a result of oxidization of the grain, and the oxide layer has a higher content of chromium or aluminum compared to the alloy grain. The oxide layer preferably has a two-layer structure comprising an inner layer 2 whose main ingredient is chromium oxide or aluminum oxide, and an outer layer 3 which is present on the outside of the inner layer and whose main ingredient is iron-chromium oxide or iron-aluminum oxide offering higher specific resistance. The outer layer 3 is formed thicker than the inner layer 2, and the surface of the soft magnetic alloy grain 1 is coated with the inner layer 2, where the soft magnetic alloy grains 1 are inter-connected via their respective outer oxide layers 3 as shown in (A) of FIG. 2 or directly without involving any oxide layer as shown in (B) of FIG. 2.

Furthermore, the outer oxide layer not involved in the inter-bonding of soft magnetic alloy grains has surface irregularities and the specific surface area of the grains is larger than before the heat treatment, which has the effect of improving the insulation property further.

Figure 3:
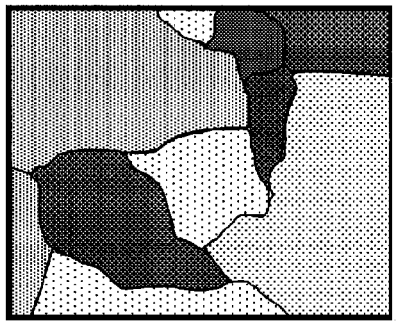
FIG. 3 is a schematic enlarged view of an area 4 encircled with a broken line in FIG. 2, illustrating crystal grains inside a grain particle.

Under the present invention, in-grain crystal grains are produced by means of sintering of the grain interior due to heat treatment, and each produced crystal grain is observed on a backscattered FE-SEM image as a brightness difference reflecting the different orientation axis of the grain. To be specific, in-grain crystal grains are checked as follows: The target product is polished to a mirror surface and then ion-milled (CP), and then captured with a field-emission scanning electron microscope (FE-SEM) at a magnification of 2000 to 10000 to obtain a backscattered electron composition image. The backscattered electron composition image shows in-grain crystal grains produced as a result of sintering under heat treatment, as multiple levels of brightness differences reflecting the different orientation axes of the grains. FIG. 3 is a schematic enlarged view of brightness differences observed on the FE-SEM backscattered electron composition image, showing the portion enclosed by the broken line 4 in FIG. 2.

If no crystal grains are produced, the backscattered electron composition image of the grain interior has a uniform brightness.

The coil-type electronic component thus achieved, which has a fine structure and uses soft magnetic alloy grains according to the present invention, exhibits superior characteristics to its conventional counterparts in terms of high magnetic permeability, high resistance and low magnetic loss.

The oxide layer can be checked by polishing the target product to a mirror surface, applying ion milling (CP), and then observing it using a scanning electron microscope (SEM).

The oxide layer can be identified as follows.

First, the base material is polished in such a way that its cross-section cut along the center line in the thickness direction is exposed, and the obtained cross-section is captured at a magnification of 3000 using a scanning electron microscope (SEM) to obtain a composition image.

The scanning electron microscope (SEM) composition image shows different constituting elements as contrast (brightness) differences. Next, the pixels of the composition image obtained above are classified into four brightness levels. The brightness levels are determined in such a way that, among the grains whose cross-section outline can be fully observed in the above composition image, a grain whose size, being calculated as the simple average D of the long-axis dimension d1 and short-axis dimension d2 of its cross-section, or D=(d1+d2)/2, is greater than the average grain size (d50%) of the material grain (material alloy grain on which no oxide layer is formed) is deemed to be of the reference brightness level of the composition contrast. Accordingly, any portion corresponding to this brightness level in the above composition image is considered a grain 1. Also, any portion whose composition contrast is one level darker than the aforementioned reference brightness level is considered an outer oxide layer 3, while any portion whose brightness level is even darker is considered an inner oxide layer 2 (refer to the schematic view in FIG. 2). Desirably, measurement is taken multiple times. Any portion whose brightness level is darker than any of the aforementioned brightness levels is considered a void (not illustrated).

As for the thickness measurement of the inner oxide layer 2 and outer oxide layer 3, the thickness of the inner layer 2 and that of the outer layer 3 can be obtained from the shortest distance from the boundary surface of the grain and the inner oxide layer 2 to the boundary surface of the outer oxide layer 3 and the void.

To be specific, the thickness of the oxide layer can be obtained as follows: A cross-section of the base material 10 in the thickness direction is captured using a SEM (scanning electron microscope) at a magnification of 1000 or 3000, and the center of gravity of one grain in the obtained composition image is obtained using imaging software, and line analysis is performed using an EDS (energy-dispersive X-ray spectrometer) from this center of gravity in the radial direction. An area whose oxygen concentration is at least three times the oxygen concentration at the center of gravity is judged an oxide (this means that, considering the measurement error, three times is set as the threshold and an area whose oxygen concentration is less than three times the oxygen concentration at the center of gravity is judged a non-oxide layer, where the oxygen concentration of an actual oxide layer can be 100 times the oxygen concentration at the center of gravity or more), and the total thickness of two oxide layers, or namely the inner layer and outer layer, is measured as the length to the outer periphery of the grain. Here, the thickness of the outer oxide layer 3 is obtained from the brightness difference as explained above, and the obtained thickness is subtracted from the total oxide layer thickness to arrive at the thickness of the inner oxide layer 2.

The total oxide layer thickness is the average thickness obtained as a simple average of the maximum and minimum thicknesses of the oxide layer present on the surface of the grain 1 identified by the aforementioned method, from the surface of the grain 1. The thickness of the outer oxide layer 3 is the average thickness obtained as a simple average of the maximum and minimum thicknesses of the outer oxide layer 3 present on the surface of the inner oxide layer 2 identified by the aforementioned method, from the surface of the inner layer 2.

Under the present invention, while the thickness of the inner oxide layer 2 and that of the outer oxide layer 3 vary among the grains, a desirable thickness range is 5 to 50 nm for the inner layer 2 and 50 to 500 nm for the outer layer 3.

The thickness of the oxide layer formed on the surface of a single alloy grain can be varied from area to area.

In an embodiment, alloy grains can be inter-bonded via oxide layers thicker than those present on the alloy grain surface (oxide layers adjacent to voids) in order to achieve high strength as a whole.

In another embodiment, alloy grains can be inter-bonded via oxide layers thinner than those present on the alloy grain surface (oxide layers adjacent to voids) in order to achieve high magnetic permeability as a whole.

In an embodiment, the average grain size of soft magnetic grains having the oxide layer is virtually or roughly the same as the average grain size of the material grain (grain before molding and heat treatment).

Under the present invention, the inner layer 2 of the aforementioned two-oxide-layer structure is an oxide layer whose main ingredient is chromium oxide or aluminum oxide, while the outer layer 3 is an oxide layer whose main ingredient is iron-chromium oxide or iron-aluminum oxide.

This two-layer structure can be checked using an EDS (energy-dispersive X-ray spectrometer) and has the effect of suppressing the drop in saturated magnetic density.

The composition ratio of grains in the above base material using a soft magnetic alloy for an electronic component (hereinafter also referred to as "a soft magnetic alloy base material for an electronic component") can be checked as follows. First, a material grain is polished until its cross-section cutting across the center of the grain is exposed, and the obtained cross-section is captured with a scanning electron microscope (SEM) at a magnification of 3000 times to obtain a composition image, which is then used to calculate the composition near the center of the grain by the ZAF method through energy diffusion X-ray analysis (EDS). Next, the above base material using a soft magnetic alloy for an electronic component is polished until its cross-section in a thickness direction cutting across roughly the center of the base material is exposed, and the obtained cross-section is captured with a scanning electron microscope (SEM) at a magnification of 3000 times to obtain a composition image. Among the grains shown in this composition image whose cross-section outline can be fully observed, a grain is extracted, whose simple average size D=(d1+d2)/2 is greater than the average grain size of material grains (d50%), where d1 and d2 represent the long-axis dimension and short-axis dimension of the cross-section of each grain, respectively, and the composition near the point of intersection of its long axis and short axis is calculated by the ZAF method through energy diffusion X-ray analysis (EDS). The result is then compared against the composition ratio in the above material grain to show the composition ratio in the alloy grain of the above base material using a soft magnetic alloy for an electronic component. (Since the composition of the material grain is known, by comparing the composition ratios determined by the ZAF method, the composition of the alloy grain can be determined.)

The base material 10 under the present invention has multiple soft magnetic alloy grains 1 and an oxide layer produced on the surface of each grain 1, where the oxide layer preferably has a two-layer structure constituted by an inner layer 2 and an outer layer 3, and the soft magnetic alloy grain 1 has a composition of 2 to 8 percent by weight of chromium, 1.5 to 7 percent by weight of silicate, and 88 to 96.5 percent by weight of iron, or 2 to 8 percent by weight of aluminum, 1.5 to 12 percent by weight of silicate, and 80 to 96.5 percent by weight of iron, where desirably the arithmetic mean size of soft magnetic grains is 30 μm or less. The inner oxide layer 2 and outer oxide layer 3 contain at least chromium or aluminum, where the peak intensity ratio of chromium or aluminum to iron in the inner layer R2 and that in the outer layer R3, as measured by energy-dispersive X-ray spectrometry using a scanning electron microscope, are both virtually greater than the peak intensity ratio of chromium or aluminum to iron in the grain R1. Also, while the main ingredient of the outer oxide layer is iron-chromium oxide or iron-aluminum oxide, the main ingredient of the inner oxide layer is chromium oxide or aluminum oxide, which means that the peak intensity ratio of chromium or aluminum to iron in the inner oxide layer 2, or R2, is greater than the peak intensity ratio of chromium or aluminum to iron in the outer oxide layer 3, or R3.

Furthermore, multiple grains partially have a void or voids in between.

Consider an example where the aforementioned soft magnetic alloy base material for an electronic component is a soft magnetic alloy whose main ingredient is iron (Fe), silicate (Si), and chromium (Cr), where the intensity ratio of chromium to iron in the grain 1, or R1, peak intensity ratio of chromium to iron in the inner oxide layer 2, or R2, and peak intensity ratio of chromium to iron in the outer oxide layer 3, or R3, can be respectively obtained as follows.

First, the composition of the point of intersection between the long axis d1 and short axis d2 in the grain 1 is obtained on the aforementioned composition image by SEM-EDS. Next, the total thickness of the oxide layer on the surface of the grain 1, and maximum thickness t1 and minimum thickness t2 of the outer layer 3, are measured on the composition image. Each average thickness (T=(t1+t2)/2) is obtained from the measured values, and the average thickness of the outer layer 3 is subtracted from the average total thickness of the oxide layer to arrive at the average thickness of the inner oxide layer 2. Next, locations whose oxide layer thickness corresponds to the average thickness of the inner layer 2 or average thickness of the outer layer 3 are identified, and the composition at the center point of the two locations is obtained by SEM-EDS. Thereafter, the peak intensity ratio of chromium to iron $R1=C1_{CrKa}/C1_{FeKa}$ can be obtained from the iron intensity $C1_{FeKa}$ and chromium intensity $C1_{CrKa}$ in the grain 1. Also, the peak intensity ratio of chromium to iron $R2=C2_{CrKa}/$ $C2_{FeKa}$ can be obtained from the iron intensity $C2_{FeKa}$ and chromium intensity $C2_{CrKa}$ at the center thickness point of the inner oxide layer 2. Furthermore, peak intensity ratio of chromium to iron $R3=C3_{CrKa}/C3_{FeKa}$ can be obtained from the iron intensity $C3_{FeKa}$ and chromium intensity $C3_{CrKa}$ at the center thickness point of the outer oxide layer 3.

As for the base material using a soft magnetic alloy for an electronic component as proposed by the present invention, the grains 1 are coated by the inner oxide layers 2 produced on the surface of the grains 1, while the outer oxide layers 3 of such grains 1 are inter-bonded (refer to (A) of FIG. 2). Under the present invention, the coating of adjacent grains 1 by the inner layers 2 of the two-oxide-layer structures produced on the surfaces of the grains 1, and inter-bonding of the outer oxide layers 3, manifest as improved magnetic characteristics and strength of the base material using the soft magnetic alloy for an electronic component.

As mentioned in detail later, the oxide layer in the present invention is produced on the surface of the grains 1 by agitating and mixing grains 1 and thermoplastic resin or other binder, compression-molding the obtained pellets, and then heat-treating the molded product, where, if the molding pressure is raised, the grains 1 are inter-bonded directly without involving any oxide layer (refer to (B) of FIG. 2) as confirmed from the result of SEM observation.

In addition, the outer surface layer of the oxide layer not involved in the inter-bonding of soft magnetic alloy grains has irregularities and the specific surface area of grains increases compared to before the heat treatment, which has the effect of improving the insulation property further.

To manufacture the base material using a soft magnetic alloy for an electronic component as proposed by the present invention, one embodiment is to add thermoplastic resin or other binder to the material grain containing chromium, silicate, and iron, or aluminum, silicate, and iron, and then agitate and mix the ingredients to obtain pellets first. Next, these pellets are compression-molded to form a molded product, and the obtained molded product is heat-treated in air at 500 to 900° C. This heat treatment in air removes the thermoplastic resin that has been mixed in, and produces a metal oxide layer on the grain surface by bonding the chromium or aluminum which was originally present in the grain and has migrated to the surface due to heat treatment, and the iron being a main ingredient of the grain, with oxygen, while at the same time the oxide layers on adjacent grains are inter-bonded and the grain interior is sintered to produce in-grain crystal grains. The oxide layer (metal oxide layer) produced on the grain surface preferably has a two-layer structure constituted by an inner layer which is produced on the alloy grain surface and whose main ingredient is chromium oxide or aluminum oxide, and an outer layer which is present on the outer side of the inner layer and whose main ingredient is an oxide containing iron and chromium or oxide containing iron and aluminum offering higher specific resistance, where the outer layer is formed thicker than the inner layer. Since the surfaces of soft magnetic grains are coated by inner layers and at least some soft magnetic grains are inter-bonded via outer layers, a base material using a soft magnetic alloy for an electronic component, which ensures insulation between the grains, can be provided.

Examples of material grain include grains manufactured by the water atomization method, while examples of the shape of the material grain include spherical and flat shapes.

Under the present invention, raising the heat treatment temperature in an oxygen ambience breaks down the binder, causing the soft magnetic alloy to be oxidized and grain interior to be sintered to produce in-grain crystal grains.

For the heat treatment conditions for molded product to form in-grain crystal grains, it is desirable to raise the temperature in air to around 500 to 900° C. at a rate of 30 to 300° C./hour and then hold this temperature for another 1 to 10 hours. By implementing the heat treatment at temperatures and rates of rise in temperature in these ranges, the grain interior is sintered and in-grain crystal grains are produced, and the aforementioned desired two-oxide-layer structure can be formed. More preferably the heat treatment can be implemented at 600 to 800° C. It can also be implemented in conditions other than in air, such as in an ambience whose partial oxygen pressure is equivalent to that in air. In a reducing ambience or non-oxidizing ambience, heat treatment does not produce a metal oxide layer, and consequently the grains are sintered together and volume resistivity drops significantly.

Although the oxygen concentration and water vapor amount in the ambience are not specifically limited, air or dry air is desired from the production viewpoint.

If the heat treatment temperature exceeds 500° C., excellent strength and excellent volume resistivity can be obtained. If the heat treatment temperature exceeds 900° C., on the other hand, strength increases but the volume resistivity drops.

Furthermore, if the rate of rise in temperature exceeds 300° C./hour, in-grain crystal grains are not produced and there will be only a single oxide layer.

Due to the heat treatment, the surface of the oxide layer that grows around the grain 1 always has irregularities, where these irregularities become more prominent when the rate of rise in temperature is lower, and absorbed in areas where the grains are inter-bonded via their outer oxide layers, but remain in areas where oxide layers are not involved in the bonding (oxide layers adjacent to voids). These irregularities formed on the grain surface increase the surface resistance and improve the insulation property further.

In addition, by setting the holding time at the above heat treatment temperature to 1 hour or more, in-grain crystal grains are formed easily and outer oxide layers 3 are also formed easily from iron-chromium or iron-aluminum metal oxide. Although the specific maximum limit of holding time is not set because the oxide layer thickness saturates at a certain value, a period of 10 hours or less is appropriate from the production viewpoint.

Furthermore, the temperature may be held at a certain level during the course of raising the temperature at the aforementioned rate. If the heat treatment temperature is 700° C., for example, it is possible to raise the temperature to around 500 to 600° C. at the aforementioned rate and then hold that temperature for 1 hour, after which the temperature is raised further to 700° C. at the aforementioned rate.

As mentioned above, use of heat treatment conditions within the aforementioned ranges achieves excellent strength and excellent volume resistivity at the same time in the process of obtaining a base material using a soft magnetic alloy having an oxide layer.

In other words, formation of in-grain crystal grains and oxide layers is controlled by the heat treatment temperature, heat treatment time, oxygen amount in the heat treatment ambience, etc.

For the soft magnetic alloy base material for an electronic component as proposed by the present invention, high magnetic permeability and high saturated magnetic flux density can be obtained by applying the above process to iron-silicate-chromium or iron-silicate-aluminum alloy powder. By this high magnetic permeability, an electronic component which is smaller than conventional components but accepts current higher than is possible with conventional components can be obtained.

In addition, no resin or glass is used, which is different from those coil components made of soft magnetic alloy grains bonded by resin or glass, meaning that no high molding pressure is needed and production cost can be kept low.

Furthermore, with the soft magnetic alloy base material for an electronic component in this embodiment, high saturated magnetic flux density is maintained and glass component, etc., will not appear on the material surface even after the heat treatment in air, and consequently a compact chip-type electronic component having high dimensional stability can be provided.

Figure 4:
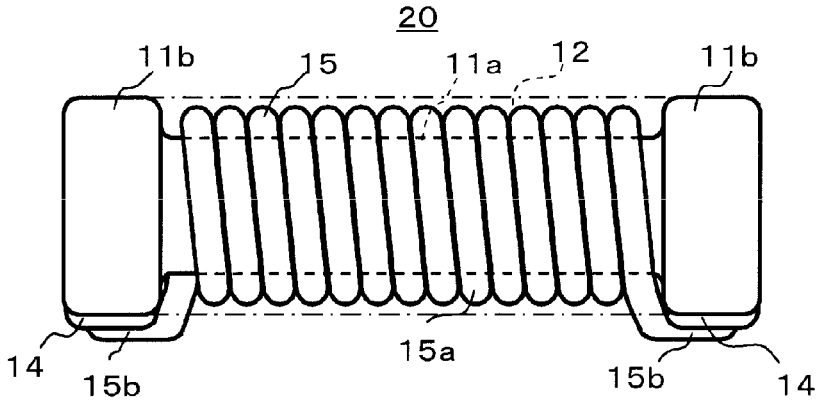
FIG. 4 is a side view, with partial perspective projection, of the first embodiment of a coil-type electronic component under the present invention.
Figure 5:
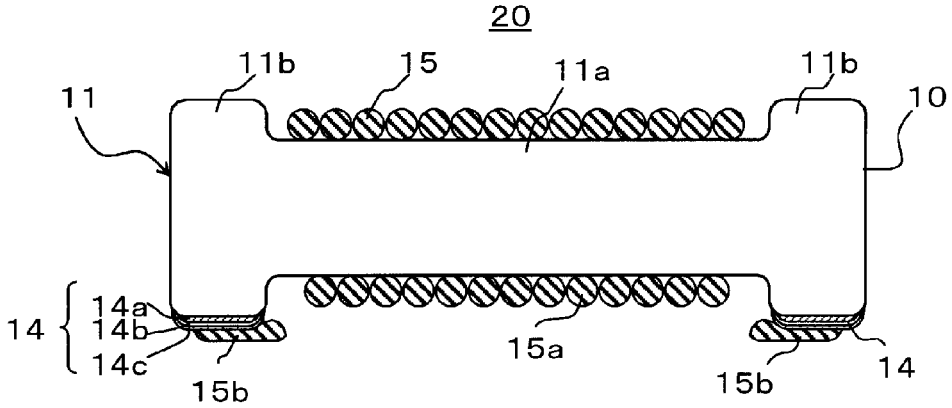
FIG. 5 is a longitudinal section view showing the internal structure of the coil-type electronic component in the first embodiment.

Next, the first embodiment of an electronic component conforming to the present invention is explained by referring to FIGS. 1, 2, 4 and 5. FIGS. 1 and 2 are not explained here, because they were already explained in connection with the earlier embodiment of base material using a soft magnetic alloy for an electronic component. FIG. 4 is a side view, with partial perspective projection, of the electronic component in this embodiment. FIG. 5 is a longitudinal section view showing the internal structure of the electronic component in this embodiment. The electronic component 20 in this embodiment is a coil-type electronic component, or specifically a winding-type chip inductor. It is comprised of a drum-type core 11 constituting the above base material 10 using a soft magnetic alloy for an electronic component, and the aforementioned base material 10, and has a pair of sheet-shaped cores 12, 12, which are not illustrated, connecting the two flange parts 11*b*, 11*b* of the drum-type core 11. On the installation surfaces of the flange parts 11, 11*b* of the core 11, a pair of external conductive films 14, 14 are formed, respectively. Also, a coil 15 constituted by an insulation coated conductive wire is wound around the winding center 11*a* of the core 11 to form a winding part 15*a*, while both ends 15*b*, 15*b* are thermo-compression-bonded to the external conductive films 14, 14 on the installation surfaces of the flange parts 11*b*, 11*b*, respectively. The external conductive films 14, 14 each have a baked conductive layer 14*a* formed on the surface of the base material 10, as well as a Ni plating layer 14*b* and Sn plating layer 14*c* that are layered on top this baked conductive layer 14*a*. The aforementioned sheet-shaped cores 12, 12 are bonded by resin adhesive to the flange parts 11*b*, 11*b* of the drum-type core 11.

The electronic component 20 in this embodiment illustrated as an example where the main elements of a soft magnetic alloy are iron, silicon, and chrome has: multiple grains containing chromium, silicon and iron; an oxide layer formed on the surface of these grains, wherein this oxide layer contains at least iron and chromium and whose peak strength ratio of chromium relative to iron is higher than the peak strength ratio of chromium relative to iron in the aforementioned grain, based on calculation by the ZAF method through energy diffusion X-ray analysis using a scanning electron microscope; and a base material 10, as a core 11, which uses the aforementioned soft magnetic alloy for an electronic component where oxide layers formed on the surfaces of the aforementioned grains adjacent to one another are bonded. At least a pair of external conductive layers 14, 14 are formed on the surface of the base material 10. The base material 10 using a soft magnetic alloy for the electronic component, which constitutes the electronic component 20 in this embodiment, is not explained here because it has already been explained earlier.

The core 11 at least has a winding center 11*a*, where the cross-section of the winding center 11*a* may be sheet-shaped (rectangular), circular or oval. Also, it is desirable that at least one flange part 11 is provided on one end of the aforementioned winding center 11*a*. With a flange part 11, the coil position relative to the winding center 11*a* can be controlled easily using the flange part 11, to help stabilize characteristics such as inductance and the like. The core 11 can be embodied in several ways, such as an embodiment with one flange part, embodiment with two flange parts (drum core), embodiment where the long-axis direction of the winding center 11*a* is placed vertically to the installation surface, and embodiment where the long-axis direction is placed horizontally to the installation surface. Especially, an embodiment where a flange part is provided only on one axial end of the winding center 11*a* and the long-axis direction of the winding center 11*a* is placed vertically to the installation surface, is preferable in reducing the height.

The external conductive film 14 is formed on the surface of the base material 10 using a soft magnetic alloy for an electronic component, and an end of the coil is connected to the external conductive film 14. The external conductive film 14 may be a baked conductive film or resin conductive film. A baked conductive film can be formed on the base material 10 using a soft magnetic alloy for an electronic component by, for example, baking a paste made of silver to which glass has been added at a specified temperature. A resin conductive film can be formed on the base material 10 using a soft magnetic alloy for an electronic component by, for example, applying a paste containing silver and epoxy resin and then treating the paste at a specified temperature. In the case of baked conductive film, heat treatment can be applied after the conductive film has been formed.

The coil may be made of copper or silver. Desirably the coil is given insulation coating. The coil may be a rectangular wire, angular wire, or rounded wire. Use of a rectangular or angular wire is desirable because the gaps between windings can be reduced and the electronic component can be kept small.

A specific example of forming the baked conductive layer 14*a* that constitutes the conductive films 14, 14 on the surface of the base material 10 using a soft magnetic alloy for an electronic component in the electronic component 20 in this embodiment, is given below. Bake-type electrode material paste containing metal grains and glass frit (bake-type Ag paste is used in this example) is applied on the installation surfaces of the flange parts 11*b*, 11*b* of the base material 10, or core 11, and then heat treatment is given in the standard atmosphere to sinter and affix the electrode material directly on the surface of the base material 10. Ni and Sn metal plating layers may also be formed, by means of electrolysis, on the surface of the baked conductive layer 14*a* that has been formed.

The electronic component 20 in this embodiment can also be obtained by the manufacturing method explained below.

Material containing material grains and binder is molded, where the specific composition of material grains is, for example, 2 to 8 percent by weight of chromium, 1.5 to 7 percent by weight of silicon and 88 to 96.5 percent by weight of iron, or 2 to 8 percent by weight of aluminum, 1.5 to 12 percent by weight of silicon and 88 to 96.5 percent by weight of iron, and bake-type electrode material paste containing metal powder and glass frit is applied on the surface of the obtained molded product at least over an area that will become the installation surface, and the resulting molded product is heat-treated at 400 to 900° C. in the standard atmosphere. Metal plating layers may also be formed on the baked conductive layer that has been formed. According to this method, an oxide layer is generated on the surface of grains, and a base material using a soft magnetic alloy for an electronic component where oxide layers on the surfaces of adjacent grains are bonded with one another can be formed simultaneously with a baked conductive layer constituting the conductive film on the surface of this base material, which simplifies the manufacturing process.

Since chromium or aluminum oxidizes more easily than iron, excessive oxidization of iron can be prevented when heat is applied in an oxidizing atmosphere, compared to pure iron.

Figure 6:
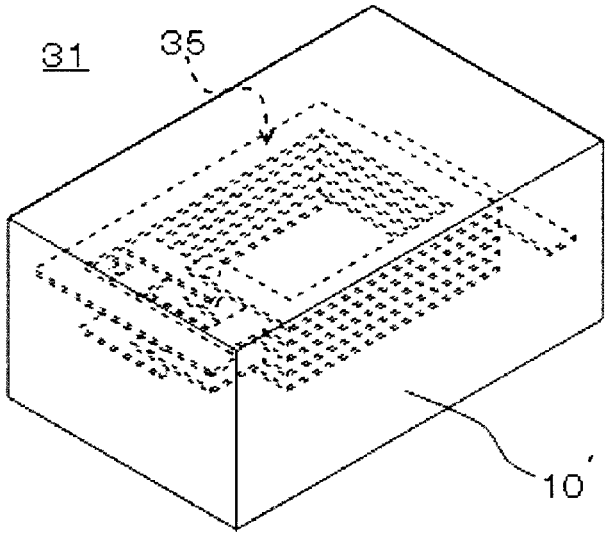
FIG. 6 is a perspective view of internal structure, showing an example of variation of the embodiment of base material using a soft magnetic alloy for an electronic component conforming to the present invention.

Next, an example of variation of the embodiment of the base material using a soft magnetic alloy for an electronic component under the present invention is explained by referring to FIG. 6. FIG. 6 is a perspective view of internal structure, showing an example of variation of the base material 10' using a soft magnetic alloy for an electronic component. The base material 10' in this example of variation has a rectangular solid appearance, while on the inside an internal coil 35 wound in helical manner is buried and the pullout parts at both ends of the internal coil 35 are exposed to a pair of opposing end faces of the base material 10'. The base material 10', together with the internal coil 35 buried inside, constitutes a laminated chip 31. Just like the base material 10 using a soft magnetic alloy for the electronic component in the first embodiment described earlier, the base material 10' using a soft magnetic alloy for the electronic component in this example of variation where the main elements of the soft magnetic alloy are iron, silicon, and chromium, for example, is also characterized in that it has: multiple grains containing chromium, silicon and iron; an oxide layer formed on the surface of these grains, wherein this oxide layer contains at least iron and chromium and whose peak strength ratio of chromium relative to iron is higher than the peak strength ratio of chromium relative to iron in the grain, based on energy diffusion X-ray analysis using a scanning electron microscope, and wherein oxide layers formed on the surfaces of adjacent grains are bonded with one another. The base material 10' using a soft magnetic alloy for the electronic component in this example of variation also has the same operations and effects as those of the base material 10 using a soft magnetic alloy for the electronic component in the first embodiment described earlier.

Figure 7:
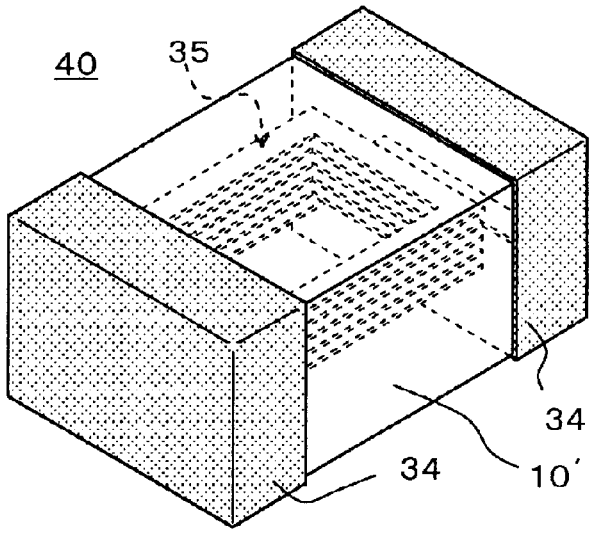
FIG. 7 is a perspective view of internal structure, showing an example of variation of the embodiment of an electronic component under the present invention.

Next, an example of variation of the embodiment of an electronic component under the present invention is explained by referring to FIG. 7. FIG. 7 is a perspective view of internal structure, showing an electronic component 40 being an example of variation. The electronic component 40 in this example of variation is constituted by the base material 10' using a soft magnetic alloy for the electronic component described in the aforementioned example of variation, where a pair of external conductive films 34, 34 are formed on or near a pair of opposing end faces of the base material in a manner connecting the exposed pullout parts of the internal coil 35. These external conductive films 34, 34, while not illustrated, have a baked conductive layer and an Ni plating layer and an Sn plating layer that are layered on top of this baked conductive layer, just like the external conductive layers 14, 14 of the electronic component 20 in the first embodiment described earlier.

It is desirable that the multiple grains constituting the base material using a soft magnetic alloy for an electronic component, as proposed by the present invention where the main elements of the soft magnetic alloy are iron, silicon, and chromium, for example, should have a composition of "2 percent by weight≤Chromium≤8 percent by weight," "1.5 percent by weight≤Silicon≤7 percent by weight" and "88 percent by weight≤Iron≤96.5 percent by weight." When the respective components are within these ranges, the base material using a soft magnetic alloy for an electronic component as proposed by the present invention demonstrates even higher strength and higher volume resistivity.

In general, soft magnetic alloys containing larger amounts of Fe have higher saturation magnetic flux densities and thereby offering better DC superimposition characteristics. However, higher Fe contents mean generation of rust in a condition of high temperature and humidity, which causes various problems in use, such as shedding of rusted material. It is a well-known fact that adding chromium to magnetic alloys is effective in raising the corrosion resistance of alloys, one representative example of which is stainless steel. However, when compacted powder magnetic cores were made from such magnetic alloy powder containing chromium by applying heat treatment in a non-oxidizing atmosphere, specific resistances measured by an insulation resistance tester were around $10^{-1}$ Ωcm, which is enough to prevent eddy-current loss between grains, but short of $10^5$ Ωcm or more needed to form an external conductive film, and as a result no metal plating layer could be formed on the baked conductive layer constituting the external conductive film.

Accordingly, under the present invention, a molded product containing a binder and material grains having the aforementioned composition is heat-treated under certain conditions in an oxidizing atmosphere to generate on the surface of grains a two-layer structure oxide layer constituted by a metal oxide layer, while covering the surface of the grains by the inner layer of the oxide layer and causing at least a portion of the oxide layer on the surface of adjacent grains to be bonded with one another by the outer layer of the oxide layer, to achieve high strength. The base material using a soft magnetic alloy for an electronic component, thus obtained, had a greatly improved volume resistivity $\rho_v$ of $10^5$ Ωcm or more, which made it possible to form plating layers of metal such as Ni, Sn and the like, without causing plating extension, on the baked conductive layer constituting the external conductive film formed on the surface of the base material.

The reason the composition is limited for the base material using a soft magnetic alloy for an electronic component, in a more favorable form of the present invention, is explained. If the chromium content in the composition of multiple grains is less than 2 percent by weight, the volume resistivity becomes low and no metal plating layer can be formed, without causing plating extension, on the baked conductive layer constituting the external conductive film.

If chromium is contained by more than 8 percent by weight, the volume resistivity also becomes low and no metal plating layer can be formed, without causing plating extension, on the baked conductive layer constituting the external conductive film. If an oxide coat is formed using Fe—Si—Al powder via heat treatment in the standard atmosphere, as described in Patent Literature 1 above, the coat is constituted by a chromium-free oxide. As a result, its volume resistivity becomes lower than $10^5$ Ωcm and no metal plating layer can be formed, without causing plating extension, on the baked conductive layer constituting the external conductive film.

With the above base material using a soft magnetic alloy for an electronic component, Si in the composition of multiple grains has the effect of improving the volume resistivity, but this effect is not achieved when the content is less than 1.5 percent by weight, while the achieved effect is not sufficient when the content is more than 7 percent by weight, and the volume resistivity is also less than $10^5$ Ωcm, which means that no metal plating layer can be formed, without causing plating extension, on the baked conductive layer constituting the external conductive film. Si also has the effect of improving the magnetic permeability, but if the content is more than 7 percent by weight, a relative decrease in Fe content causes the saturation magnetic flux density to drop. It also results in lower moldability, which is another factor that lowers the magnetic permeability and the saturation magnetic flux density.

With the above base material using a soft magnetic alloy for an electronic component, the saturation magnetic flux density drops, while moldability also drops to decrease the magnetic permeability and saturation magnetic flux density, if the iron content in the composition of multiple grains is less than 88 percent by weight. If the iron content is more than 96.5 percent by weight, the volume resistivity drops due to a relative drop in chromium content and silicon content.

If aluminum is used, desirably the composition is 2 to 8 percent by weight of aluminum, 1.5 to 12 percent by weight of silicate, and 80 to 96.5 percent by weight of iron.

If the aluminum content in the composition of multiple grains is less than 2 percent by weight, the volume resistivity becomes low and a metal plating layer cannot be formed on the baked conductive layer constituting the external conductive film without causing the plating to stretch. If the aluminum content is greater than 8 percent by weight, on the other hand, the Fe content decreases relatively and the saturated magnetic flux density decreases as a result.

Under the present invention, it is also desirable that the average size of multiple grains is 5 to 30 μm in equivalent average grain size d50% (arithmetic mean) of material grains. Also note that the average size of multiple grains mentioned above can be approximated by a value obtained by capturing a composition image of a cross-section of the base material using a scanning electron microscope (SEM) at a magnification of 3000 times, and then dividing the total sum of simple averages D=(d1+d2)/2 of grains whose cross-section outline can be fully observed, by the total number of grains, where d1 and d2 represent the long-axis dimension and short-axis dimension of the cross-section of each grain, respectively.

The group of alloy metal grains has a granular distribution, and grains are not necessarily circular but have irregular shapes instead. When solid alloy metal grains are observed two-dimensionally (on a plane), their size varies depending on which cross-section is observed. Accordingly, under the present invention, the average grain size is evaluated by measuring more grains. In this sense, it is desirable to measure at least 100 applicable grains under the conditions specified below. The specific method is as follows. First the largest diameter of the grain cross-section represents the long axis, and the point that equally divides the length of the long axis is obtained. Next, the smallest diameter of the grain cross-section that includes this point represents the short axis. The two are defined as the long-axis dimension and short-axis dimension, respectively. Grains to be measured are arranged sequentially from the one having the largest diameter of its cross-section, and measurement is performed until the cumulative ratio of grain cross-sections accounts for 95% of all area shown in the scanning electron microscope (SEM) image excluding grains whose cross-section outline is cannot be fully observed, voids, and oxide layers. As long as the average grain size mentioned above is within the specified range, high saturation magnetic flux density (1.4 T or more) and high magnetic permeability (27 or more) can be obtained, and generation of eddy-current loss in the grain can be prevented even at frequencies of 100 kHz and above.

In the present disclosure, disclosed numeral numbers refer to approximate numbers in some embodiments, and the upper and lower endpoints of described ranges are included in some embodiments, or excluded in some embodiments. Further, in some embodiments, numeral numbers refer to average numbers, representative numbers, median, etc.

EXAMPLES

The following explains the present invention in greater detail using examples and a comparative example. It should be noted, however, that the present invention is not at all limited to these examples and the comparative example.

To determine the level of magnetic characteristics of each base material using a soft magnetic alloy for an electronic component, grain materials were molded into a toroidal shape of 14 mm in outer diameter, 8 mm in inner diameter and 3 mm in thickness by adjusting the molding pressure to between 6 and 12 tons/cm$^2$ so that the fill ratio of material grains would become 80 percent by volume, after which the molded product was heat-treated in the standard atmosphere and a coil constituted by urethane-coated copper wire of 0.3 mm in diameter was wound around the obtained base material by 20 turns to obtain a test sample. Magnetic permeability μ was measured with an L chromium meter (4285A manufactured by Agilent Technologies) at a measurement frequency of 100 kHz.

Also, magnetic loss Pcv was measured with alternating-current BH analyzers (SY-8232 and SY-301 by Iwatsu Electric) at a frequency of 1 MHz and magnetic flux density of 50 mT, using a test sample prepared by heat-treating a toroidal base material as above and then wrapping it by 5 turns with a primary coil and a secondary coil made of urethane-coated copper wire of 0.3 mm in diameter.

Figure 8:
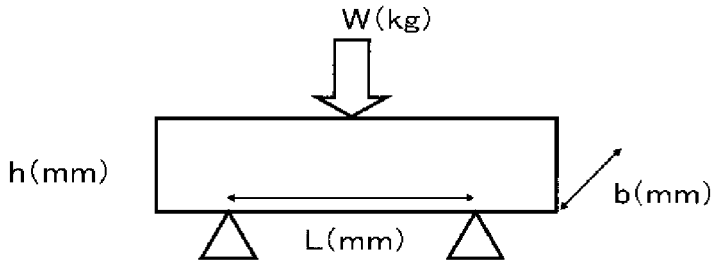
FIG. 8 is an explanation drawing showing how samples were measured for 3-point bending rupture stress in examples of the present invention.

To determine the level of strength of each base material using a soft magnetic alloy for an electronic component, 3-point bending rupture stress was measured, as follows, according to the measurement method illustrated in FIG. 8. Each test piece used for measurement of 3-point bending rupture stress was prepared by molding material grains into a sheet shape of 50 mm in length, 10 mm in width and 4 mm in thickness by adjusting the molding pressure to between 6 and 12 tons/cm$^2$ so that the fill ratio of material grains would become 80 percent by volume, and then heat-treating the molded product in the standard atmosphere.

Figure 9:
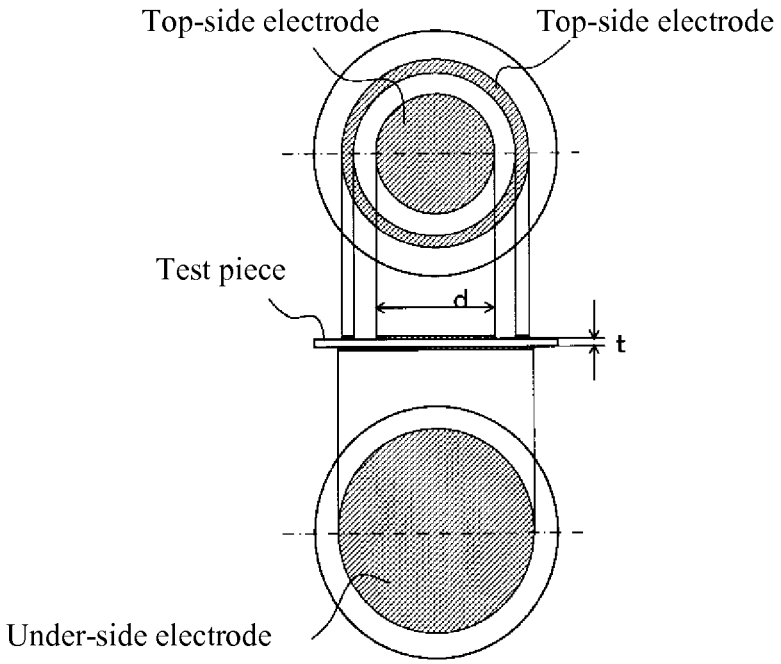
FIG. 9 is an explanation drawing showing how samples were measured for volume resistivity in examples of the present invention.

In addition, to determine the level of volume resistivity of each base material using a soft magnetic alloy for an electronic component, measurement was performed, as shown in FIG. 9, according to JIS-K6911. Each test piece used for measurement of volume resistivity was prepared by molding material grains into a disk shape of 100 mm in diameter and 2 mm in thickness by adjusting the molding pressure to between 6 and 12 tons/cm$^2$ so that the fill ratio of material grains would become 80 percent by volume, and then heat-treating the molded product in the standard atmosphere.

Example 1

For the material grains to obtain a base material using a soft magnetic alloy for an electronic component, alloy powder (PF-20F manufactured by Epson Atmix K.K.) was used which is a type of water-atomized powder whose average grain size (d50%) is 10μ and composition ratio was 5 percent by weight of chromium, 3 percent by weight of silicon and 92 percent by weight of iron. The average grain size d50% of material grains described above was measured using a granularity analyzer (9320HRA manufactured by Nikkiso). Each of the above grains was polished until its cross-section in a thickness direction cutting across roughly the center of the grain was exposed, and the obtained cross-section was captured with a scanning electron microscope (SEM:

S-4300SE/N manufactured by Hitachi High-Technologies) at a magnification of 3000 times to obtain a composition image, which was then used to calculate the composition near the center of the grain and also near the surface by the ZAF method through energy diffusion X-ray analysis (EDS), confirming that the above composition ratio near the center of the grain was roughly the same as the corresponding composition ratio near the surface. Next, the above grains were mixed with polyvinyl butylal (S-LEC BL, a solution with a solid concentration of 30 percent by weight, manufactured by Sekisui Chemical) using a wet-type rolling agitator to obtain pellets. The obtained pellets were molded into an angular sheet shape of 50 mm in length, 10 mm in width and 4 mm in thickness; a disk shape of 100 mm in diameter and 2 mm in thickness; a toroidal shape of 14 mm in outer diameter, 8 mm in inner diameter and 3 mm in thickness; a drum-type core having angular flange parts (1.6 mm wide×0.6 mm high×0.3 mm thick) at both ends of winding core parts (1.0 mm wide×0.36 mm high, ×1.4 mm long); and a pair of sheet-shaped cores (2.0 mm long×0.5 mm wide, ×0.2 mm thick), by setting a molding pressure at 8 tons/cm$^2$ so that the fill ratio of multiple grains would become 80 percent by volume. The disk-shaped molded product, toroidal molded product, drum-type molded product and pair of sheet-shaped molded products, as obtained above, were heated to 700° C. at a heating-up rate of 100° C./hour and heat-treated for 3 hours in the standard atmosphere.

The disk-shaped base material obtained by heat-treating the above disk-shaped molded product was measured for magnetic permeability μ, 3-point bending rupture stress, and volume resistivity according to JIS-K6911, and the result is shown in Table 1.

It was confirmed that, when a drum-type base material obtained by heat-treating the above drum-type molded product was polished to a mirror surface and ion-milled (CP) and then a backscattered electron composition image was taken by a field-emission scanning electron microscope (FE-SEM) and observed, in-grain crystal grains had been produced.

Also, the drum-type base material was polished until its cross-section in thickness direction cutting across roughly the center of the winding center was exposed, and the obtained cross-section was captured with a scanning electron microscope (SEM) at a magnification of 3000 times to obtain a composition image. Next, pixels of the composition image obtained above were classified into four contrast levels. The contrast ranks were determined in such a way that, among the grains shown in the above composition image whose cross-section outline could be fully observed, those whose simple average size D=(d1+d2)/2 was greater than the average grain size of material grains (d50%), where d1 and d2 represent the long-axis dimension and short-axis dimension of the cross-section of each grain, respectively, were deemed to be of the reference brightness rank of composition contrast, and any part of the above composition image corresponding to this brightness rank was judged as a grain 1. On the other hand, any part whose composition contrast was next darker than the above reference brightness rank was judged as an outer layer of an oxide layer 3, and any part whose contrast was further darker than the above was judged as an inner layer of an oxide layer 2. In addition, any part whose contrast was the darkest was judged as a void 3 (not shown). The obtained result confirms that the outer layer 3 of the oxide layer formed on the surface of the adjacent grains 1 was bonded with one another.

Next, among the grains shown in this composition image whose cross-section outline could be fully observed, a grain whose simple average size D=(d1+d2)/2 was greater than the average grain size of material grains (d50%), where d1 and d2 represent the long-axis dimension and short-axis dimension of the cross-section of each grain, respectively, was extracted and the composition near the point of intersection of its long axis and short axis was calculated by the ZAF method through energy diffusion X-ray analysis (EDS). The result was then compared against the composition ratio of the above material grain to confirm that the composition ratio of multiple grains constituting the above base material was roughly or substantially the same as the composition ratio of material grains.

Next, the composition of the point of intersection between the long axis d1 and short axis d2 in the grain 1 was obtained on the aforementioned composition image by SEM-EDS. Next, the composition at the center thickness point of the oxide layer at a location whose oxide layer thickness corresponds to the average thickness of the maximum thickness t1 and minimum thickness t2 of the oxide layer on the surface of the grain 1, calculated by T=(t1+t2)/2, was obtained by SEM-EDS on the aforementioned composition image.

From the above results, the soft magnetic alloy base material for the electronic component in Example 1 was confirmed to have multiple grains 1 containing 5 percent by weight of chromium, 3 percent by weight of silicate, and 92 percent by weight of iron, and a two-oxide-layer structure produced on the surface of each grain 1, where the inner oxide layer 2 contains chromium oxide as its main ingredient and has an average thickness of 40 nm, while the outer oxide layer 3 contains iron-chromium oxide as its main ingredient and has an average thickness of 70 nm.

The obtained results are shown in Table 1.

As shown, good measurement results were obtained, such as 59 in magnetic permeability μ, 14 kgf/mm$^2$ in base material strength (rupture stress), 4.2×10$^7$Ω in volume resistivity, and 9.8×10$^6$ W/m$^3$ in magnetic loss Pcv.

Next, a coil made of insulated sheathed conductive wire was wrapped around the winding core of the aforementioned drum-type base material and both ends of the coil were thermally bonded to the external conductive film, respectively, and a sheet-shaped base material obtained by heat-treating the aforementioned sheet-shaped molded product was bonded by resin adhesive to both sides of the flange part of the drum-type base material, to obtain a winding-type chip inductor.

Example 2

An evaluation sample was prepared in the same manner as in Example 1, except that the composition ratio of the material grain was changed to 3 percent by weight of chromium, 5 percent by weight of silicate, and 92 percent by weight of iron. The obtained results are shown in Table 1.

As shown in Table 1, good measurement results were obtained, just as in Example 1, such as 53 in magnetic permeability μ, 9 kgf/mm$^2$ in base material strength (rupture stress), 2.0×10$^7$ Ω·cm in volume resistivity, and 1.1×10$^7$ W/m$^3$ in magnetic loss Pcv.

FE-SEM observation, SEM observation, and SEM-EDS analysis, performed in the same manner as in Example 1, also confirmed that in-grain crystal grains had formed due to heat treatment, and a metal oxide (oxide layer) had also formed on the grain surface, where the formed oxide layer had a two-layer structure constituted by an inner layer 2 (average thickness: 30 nm) formed by chromium oxide and an outer layer 3 (average thickness: 66 nm) formed by iron-chromium oxide, with the outer oxide layers 3 bonding together.

Example 3

An evaluation sample was prepared in the same manner as in Example 1, except that the composition ratio of the material grain was changed to 6 percent by weight of chromium, 2 percent by weight of silicate, and 92 percent by weight of iron. The obtained results are shown in Table 1.

As shown in Table 1, good measurement results were obtained, just as in Example 1, such as 49 in magnetic permeability μ, 14 kgf/mm$^2$ in base material strength (rupture stress), $7.0\times10^6$ Ω·cm in volume resistivity, and $2.0\times10^7$ W/m$^3$ in magnetic loss Pcv.

FE-SEM observation, SEM observation, and SEM-EDS analysis, performed in the same manner as in Example 1, also confirmed that in-grain crystal grains had formed due to heat treatment, and a metal oxide (oxide layer) had also formed on the grain surface, where the formed oxide layer had a two-layer structure constituted by an inner layer 2 (average thickness: 50 nm) formed by chromium oxide and an outer layer 3 (average thickness: 80 nm) formed by iron-chromium oxide, with the outer oxide layers 3 bonding together.

Example 4

An evaluation sample was prepared in the same manner as in Example 1, except that the composition ratio of the material grain was changed to 6 percent by weight of chromium, 4 percent by weight of silicate and 94 percent by weight of iron. The obtained results are shown in Table 1.

As shown in Table 1, good measurement results were obtained, just as in Example 1, such as 50 in magnetic permeability μ, 14 kgf/mm$^2$ in base material strength (rupture stress), $8.0\times10^6$ Ω·cm in volume resistivity, and $1.2\times10^7$ W/m$^3$ in magnetic loss Pcv.

FE-SEM observation, SEM observation, and SEM-EDS analysis, performed in the same manner as in Example 1, also confirmed that in-grain crystal grains had formed due to heat treatment, and a metal oxide (oxide layer) had also formed on the grain surface, where the formed oxide layer had a two-layer structure constituted by an inner layer 2 (average thickness: 40 nm) formed by chromium oxide and an outer layer 3 (average thickness: 75 nm) formed by iron-chromium oxide, with the outer oxide layers 3 bonding together.

Example 5

An evaluation sample was prepared in the same manner as in Example 1, except that the composition ratio of the material grain was changed to 4 percent by weight of chromium, 2 percent by weight of silicate, and 89 percent by weight of iron. The obtained results are shown in Table 1.

As shown in Table 1, good measurement results were obtained, just as in Example 1, such as 49 in magnetic permeability μ, 18 kgf/mm$^2$ in base material strength (rupture stress), $5.1\times10^5$ Ω·cm in volume resistivity, and $2.3\times10^7$ W/m$^3$ in magnetic loss Pcv.

FE-SEM observation, SEM observation, and SEM-EDS analysis, performed in the same manner as in Example 1, also confirmed that in-grain crystal grains had formed due to heat treatment, and a metal oxide (oxide layer) had also formed on the grain surface, where the formed oxide layer had a two-layer structure constituted by an inner layer 2 (average thickness: 35 nm) formed by chromium oxide and an outer layer 3 (average thickness: 70 nm) formed by iron-chromium oxide, with the outer oxide layers 3 bonding together.

Example 6

An evaluation sample was prepared in the same manner as in Example 1, except that the molding pressure was changed to 12 tons/cm$^2$. The obtained measurement results are shown in Table 1.

As shown in Table 1, good measurement results were obtained, just as in Example 1, such as 59 in magnetic permeability μ, 15 kgf/mm$^2$ in base material strength (rupture stress), $4.2\times10^5$ Ω·cm in volume resistivity, and $9.2\times10^6$ W/m$^3$ in magnetic loss Pcv.

FE-SEM observation, SEM observation, and SEM-EDS analysis, performed in the same manner as in Example 1, also confirmed that in-grain crystal grains had formed due to heat treatment, and a metal oxide (oxide layer) had also formed on the grain surface, where the formed oxide layer had a two-layer structure constituted by an inner layer 2 (average thickness: 35 nm) formed by chromium oxide and an outer layer 3 (average thickness: 65 nm) formed by iron-chromium oxide.

In addition, SEM observation performed in the same manner as in Example 1 found a presence of grains inter-bonded directly, without involving any oxide layer. This was probably due to the higher molding pressure that increased the contact area between grains.

Example 7

An evaluation sample was prepared in the same manner as in Example 1, except that the composition ratio of the material grain was changed to 5.5 percent by weight of aluminum, 9.5 percent by weight of silicate, and 85 percent by weight of iron. The obtained measurement results are shown in Table 1.

As shown in Table 1, good measurement results were obtained, just as in Example 1, such as 45 in magnetic permeability μ, 9 kgf/mm$^2$ in base material strength (rupture stress), $4.2\times10^4$ Ωcm in volume resistivity, and $9.5\times10^6$ W/m$^3$ in magnetic loss Pcv.

Comparative Example 1

An evaluation sample was prepared in the same manner as in Example 1, except that the rate of rise in temperature during heat treatment was changed to 400° C./hour. The obtained measurement results are shown in Table 1.

As shown in Table 1, the magnetic permeability μ was 45, base material strength (rupture stress) was 7.4 kgf/mm$^2$, volume resistivity was $4.2\times10^5$ Ω·cm and magnetic loss Pcv was $5.3\times10^7$ W/m$^3$, none of which was better than the measurement results of Examples 1 to 6.

In addition, SEM observation and SEM-EDS analysis performed in the same manner as in Example 1 confirmed that, although grains were inter-bonded via metal oxides (oxide layers) formed on their surface due to heat treatment, the oxide layers had only a single layer of iron-chromium oxide.

Comparative Example 2

An evaluation sample was prepared in the same manner as in Example 7, except that the rate of rise in temperature during heat treatment was changed to 400° C./hour. The obtained measurement results are shown in Table 1.

As shown in Table 1, the magnetic permeability μ was 32, base material strength (rupture stress) was 1.4 kgf/mm$^2$, volume resistivity was $8.0\times10^3$ Ω·cm and magnetic loss Pcv was $3.9\times10^7$ W/m$^3$, none of which was better than the measurement results of Examples 1 to 6.

In addition, SEM observation and SEM-EDS analysis performed in the same manner as in Example 1 confirmed that, although grains were inter-bonded via metal oxides (oxide layers) formed on their surface due to heat treatment, the oxide layers had only a single layer of iron-aluminum oxide.

TABLE 1

| | Composition (percent by weight) | | | | | Rupture stress | Volume resistivity | Loss Pcv (W/m$^3$ | Presence/ absence of in-grain |
|---|---|---|---|---|---|---|---|---|---|
| | Cr | Si | Al | Fe | μ | kgf/mm$^2$ | Ω · cm | @1 MHz, 50 mT | crystal |
| Example 1 | 5 | 3 | — | 92 | 59 | 14 | $4.2 \times 10^7$ | $9.8 \times 10^6$ | ○ |
| Example 2 | 3 | 5 | — | 92 | 53 | 9 | $2.0 \times 10^7$ | $1.1 \times 10^7$ | ○ |
| Example 3 | 6 | 2 | — | 92 | 49 | 14 | $7.0 \times 10^6$ | $2.0 \times 10^7$ | ○ |
| Example 4 | 6 | 4 | — | 94 | 50 | 14 | $8.0 \times 10^6$ | $1.2 \times 10^7$ | ○ |
| Example 5 | 4 | 2 | — | 89 | 49 | 18 | $5.1 \times 10^5$ | $2.3 \times 10^7$ | ○ |
| Example 6 | 5 | 3 | — | 92 | 59 | 15 | $4.2 \times 10^5$ | $9.2 \times 10^6$ | ○ |
| Example 7 | — | 9.5 | 5.5 | 85 | 45 | 9 | $4.2 \times 10^4$ | $9.5 \times 10^6$ | ○ |
| Comparative example 1 | 5 | 3 | — | 92 | 45 | 7.4 | $4.2 \times 10^5$ | $5.3 \times 10^7$ | — |
| Comparative example 1 | — | 9.5 | 5.5 | 85 | 32 | 1.4 | $8.0 \times 10^3$ | $3.9 \times 10^7$ | — |

A soft magnetic alloy base material for an electronic component according to the present invention, and an electronic component using such base material, are suitable for a compact electronic component that can be surface-mounted on a circuit board. In particular, they are suitable for size reduction of power inductor components through which high current flows.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, an article "a" may refer to a species or a genus including multiple species, and "the invention" or "the present invention" may refer to at least one of the embodiments or aspects explicitly, necessarily, or inherently disclosed herein. In this disclosure, any defined meanings do not necessarily exclude ordinary and customary meanings in some embodiments.

The present application claims priority to Japanese Patent Application No., 2011-274265 filed Dec. 15, 2011, the disclosure of which, including the claims, is incorporated herein by reference in its entirety. In some embodiments, as the soft magnetic alloy grains, for example, those disclosed in U.S. Patent Application Publication No. 2011/0267167, No. 2012/0038449, No. 2012/0188049, and No. 2012/0188046, and co-pending U.S. patent application Ser. No. 13/662,035, can be used, each disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

I claim:

1. A coil-type electronic component having a coil inside or on the surface of a base material, wherein the base material is constituted by a group of inter-bonded grains consisting of soft magnetic alloy grains and oxide layers covering the soft magnetic alloy grains, some of said grains being inter-bonded via the oxide layers whereas some of said grains being directly inter-bonded without involving any oxide layer, and multiple in-grain crystal grains having different orientation axes are present within each soft magnetic alloy grain, said multiple in-grain crystal grains having different orientation axes being such grains formed in an oxygen ambience where the temperature is raised to 500 to 900° C. at a rate of 30 to 300° C./hour.

2. A coil-type electronic component according to claim 1, wherein the soft magnetic alloy contains iron, chromium, and silicate as its main ingredients.

3. A coil-type electronic component according to claim 1, wherein the soft magnetic alloy contains iron, aluminum, and silicate as its main ingredients.

4. A coil-type electronic component according to claim 1, wherein the oxide layers have a two-layer structure where an outer layer is thicker than an inner layer.

5. A coil-type electronic component according to claim 1, wherein the surface of the outer layer of the oxide layer not inter-bonding the soft magnetic alloy grains has irregularities.

6. A coil-type electronic component according to claim 1, wherein the average size of the soft magnetic alloy grains is 5 to 30 μm in equivalent average grain size d50% (arithmetic mean).

7. A coil-type electronic component according to claim 4, wherein the main component of the inner layer is chromium oxide or aluminum oxide and the main component of the outer layer is iron-chromium oxide or iron-aluminum oxide.

8. A coil-type electronic component according to claim 1, wherein the grains are inter-bonded only by the oxide layers and the direct bonding.

* * * * *